US009524696B2

(12) United States Patent
Nakata et al.

(10) Patent No.: US 9,524,696 B2
(45) **Date of Patent: *Dec. 20, 2016**

(54) IMAGE PROJECTION DEVICE

(71) Applicant: RICOH COMPANY, LIMITED, Tokyo (JP)

(72) Inventors: Otoichi Nakata, Kanagawa (JP); Fumihiro Nakashige, Kanagawa (JP); Shinichi Sumiyoshi, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 191 days.

This patent is subject to a terminal disclaimer.

(21) Appl. No.: 14/447,866

(22) Filed: Jul. 31, 2014

(65) Prior Publication Data

US 2015/0042701 A1 Feb. 12, 2015

(30) Foreign Application Priority Data

Aug. 6, 2013 (JP) ..... 2013-163593
Jul. 17, 2014 (JP) ..... 2014-146793

(51) Int. Cl.

| | |
|---|---|
| ***G09G 5/10*** | (2006.01) |
| ***G09G 5/02*** | (2006.01) |
| ***G09G 5/12*** | (2006.01) |
| ***G09G 5/08*** | (2006.01) |
| *G09G 5/04* | (2006.01) |

(52) U.S. Cl.

CPC ..... *G09G 5/10* (2013.01); *G09G 5/026* (2013.01); *G09G 5/08* (2013.01); *G09G 5/12* (2013.01); *G09G 5/04* (2013.01); *G09G 2320/0666* (2013.01); *G09G 2320/0693* (2013.01); *G09G 2354/00* (2013.01)

(58) Field of Classification Search

CPC combination set(s) only.
See application file for complete search history.

(56) References Cited

U.S. PATENT DOCUMENTS

2003/0174163 A1* 9/2003 Gnanamgari ..... G06F 3/0386 715/738
2004/0041786 A1* 3/2004 Inoue ..... G06F 3/0386 345/156
2006/0170874 A1* 8/2006 Yumiki ..... G03B 17/54 353/42

FOREIGN PATENT DOCUMENTS

| | | |
|---|---|---|
| JP | 11-271675 | 10/1999 |
| JP | 2005-091176 | 4/2005 |
| JP | 3733915 | 1/2006 |

* cited by examiner

*Primary Examiner* — Jason Olson
*Assistant Examiner* — Sosina Abebe
(74) *Attorney, Agent, or Firm* — Oblon, McClelland, Maier & Neustadt, L.L.P.

(57) ABSTRACT

An image projection device includes: a drive control unit that generates colors sequentially; a setting unit that sets a color of an illumination image; an image capturing control unit that receives, from the drive control unit, a synchronization signal that specifies a timing at which light of a color closest to the set color of the illumination image is not projected and causes an image of a projection surface to be captured in accordance with the timing that is specified by the synchronization signal; an illumination image detection unit that detects, from captured image data, an illumination image that is produced by illuminating the projection surface by an illuminating device; and an illumination image generation unit that generates projection image data obtained by combining given image data at a position at which the illumination image is detected.

11 Claims, 13 Drawing Sheets

IMAGE PROJECTION DEVICE

CROSS-REFERENCE TO RELATED APPLICATIONS

The present application claims priority to and incorporates by reference the entire contents of Japanese Patent Application No. 2013-163593 filed in Japan on Aug. 6, 2013 and Japanese Patent Application No. 2014-146793 filed in Japan on Jul. 17, 2014.

BACKGROUND OF THE INVENTION

1. Field of the Invention

The present invention relates to an image projection device.

2. Description of the Related Art

Projectors project enlarged images, such as letters or graphs, and thus are widely used in presentations for a large number of people, or the like. In a presentation, the presenter may point to an image that is projected on the screen with, for example, a pointer in order to make explanation easy to understand. However, directly pointing to a projected image with a laser pointer has a problem in that a desired part cannot be pointed to accurately due to trembling of the hand. Accordingly, a technique according to Japanese Laid-open Patent Publication No. H11-271675 has been already known in which a built-in CCD (Charge Coupled Device) camera of a projector detects the spot that is illuminated by a user with a laser pointer and a pointer image is displayed on the same spot as the illuminated spot.

However, detection of a spot that is illuminated with a laser pointer from a video image that is captured by a camera in the conventional manner has a problem in that, when the color of the laser pointer is similar to the color or luminance of a projected video image, there is a possibility that the laser pointer cannot be detected depending on the content of projection.

In view of the above, there is a need to provide an image projection device that can accurately detect a spot that is illuminated by an illuminating device, such as a laser pointer.

SUMMARY OF THE INVENTION

It is an object of the present invention to at least partially solve the problems in the conventional technology.

An image projection device includes: a drive control unit that generates colors sequentially; a setting unit that sets a color of an illumination image; an image capturing control unit that receives, from the drive control unit, a synchronization signal that specifies a timing at which light of a color closest to the set color of the illumination image is not projected and causes an image of a projection surface to be captured in accordance with the timing that is specified by the synchronization signal; an illumination image detection unit that detects, from captured image data, an illumination image that is produced by illuminating the projection surface by an illuminating device; and an illumination image generation unit that generates projection image data obtained by combining given image data at a position at which the illumination image is detected.

An image projection device includes: a drive control unit that generates colors sequentially; a setting unit that sets a color of an illumination image; an image capturing control unit that receives, from the drive control unit, a synchronization signal that specifies a timing at which light of a color closest to the set color of the illumination image is not projected and causes an image of a projection surface to be captured in accordance with the timing that is specified by the synchronization signal; a light spot device that produces a light spot around the projection surface from the captured image data; a light spot detection unit that detects the light spot that is produced around the light spot device; and a light spot image generation unit that generates projection image data obtained by combining given image data at a position at which the light spot is detected.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

Figure 1:
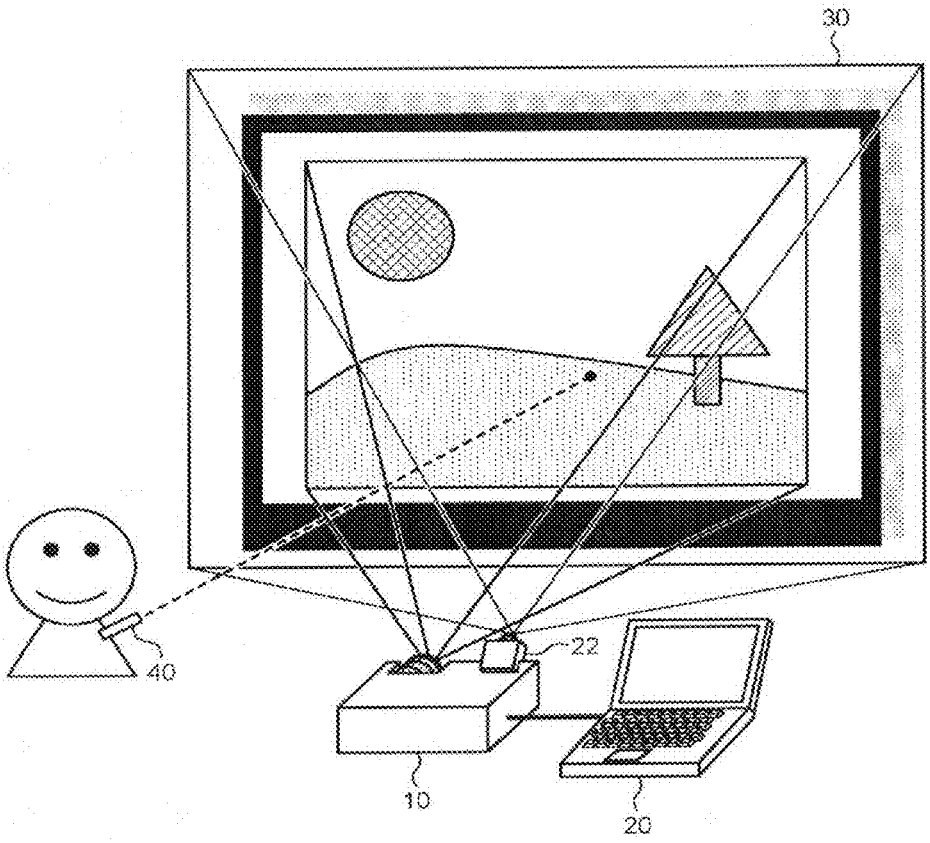
FIG. 1 is a general view showing a mode in which an image projection device according to an embodiment is used.

An image projection device according to an embodiment of the invention will be described below with reference to the accompanying drawings. FIG. 1 is a general view of an image projection system including an image projection device. An image projection device 10 is connected to an external PC 20 and projects image data, such as a still image or moving image, that is input from the external PC 20 onto a screen 30 serving as a projection surface. FIG. 1 illustrates a case where a user uses a laser pointer 40 as an illuminating device. A camera unit 22 is connected to the image projection device 10. The camera unit 22 may be provided as external hardware or may be a built-in unit of the image projection device 10.

Figure 2:
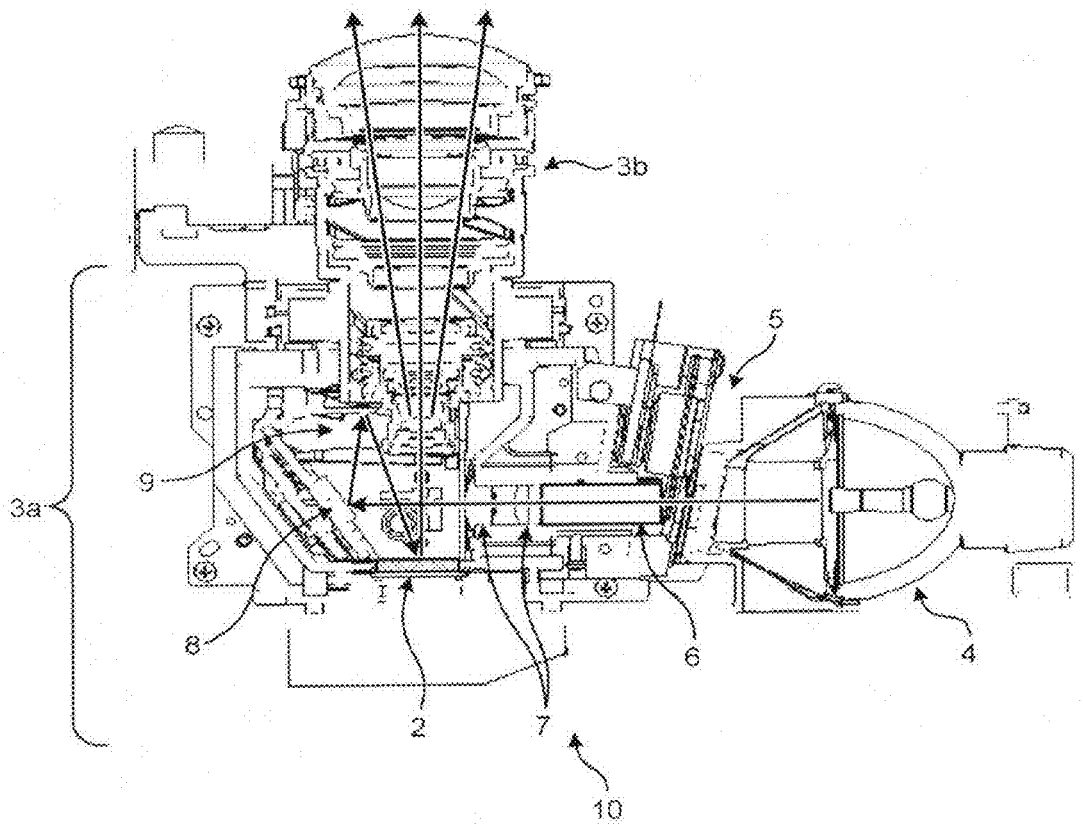
FIG. 2 illustrates an internal configuration of hardware of the image projection device according to the embodiment.

FIG. 2 illustrates an internal hardware configuration of the image projection device. As illustrated in FIG. 2, the image projection device 10 includes an optical system 3*a* and a projection system 3*b*. The optical system 3*a* includes a color wheel 5, a light tunnel 6, a relay lens 7, a plane mirror 8, and a concave mirror 9. The components are provided in the main unit of the image projection device 10. The image projection device 10 is provided with an image forming unit 2. The image forming unit 2 is configured using a DMD element that is an image forming element that forms an image.

The discoid color wheel 5 converts, in time units, white light from a light source 4 into light of colors R, G and B and emits the converted light toward the light tunnel 6. In the embodiment, a configuration for detecting a laser pointer in the image projection device 10 using the color wheel 5 will be described. A detailed configuration of the color wheel 5 will be described below. The light tunnel 6 is made by adhering plate glasses to have a cylindrical shape and guides the light emitted from the color wheel 5 to the relay lens 7. The relay lens 7 is constructed by combining two lenses and focuses the light emitted from the light tunnel 6 while correcting the chromatic aberration of the light on the optical axis. The plane mirror 8 and the concave mirror 9 reflect the light emitted by the relay lens 7 and guide the light to the image forming unit 2 to cause the light to be focused. The image forming unit 2 includes a DMD that has rectangular mirror surfaces consisting of multiple micromirrors where time-division driving is performed on the micromirrors on the basis of video image or image data so as to process and reflect the projected light so that given image data is formed.

For the light source 4, for example, a high pressure mercury lamp is used. The light source 4 emits white light toward the optical system 3*a*. In the optical system 3*a*, the white light emitted from the light source 4 is divided into light of R, G and B and the light is guided to the image forming unit 2. The image forming unit 2 forms an image according to modulation signals. The projection system 3*b* projects an enlarged image of the formed image.

An OFF light plate that receives unnecessary light not used as projection light from among the light incident on the image forming unit 2 is provided above the image forming unit 2 illustrated in FIG. 2 in the vertical direction, that is, on the front side of the image forming unit 2 in FIG. 2. When light is incident on the image forming unit 2, the DMD causes the multiple micromirrors to operate on the basis of the video data in a time-division manner. The micromirrors reflect light to be used toward the projection lens and light to be discarded toward the OFF light plate. The image forming unit 2 reflects the light to be used for a projection image toward the projection system 3*b* where enlargement is performed via multiple projection lenses and the enlarged video image light is projected in an enlarged manner.

Figure 3:
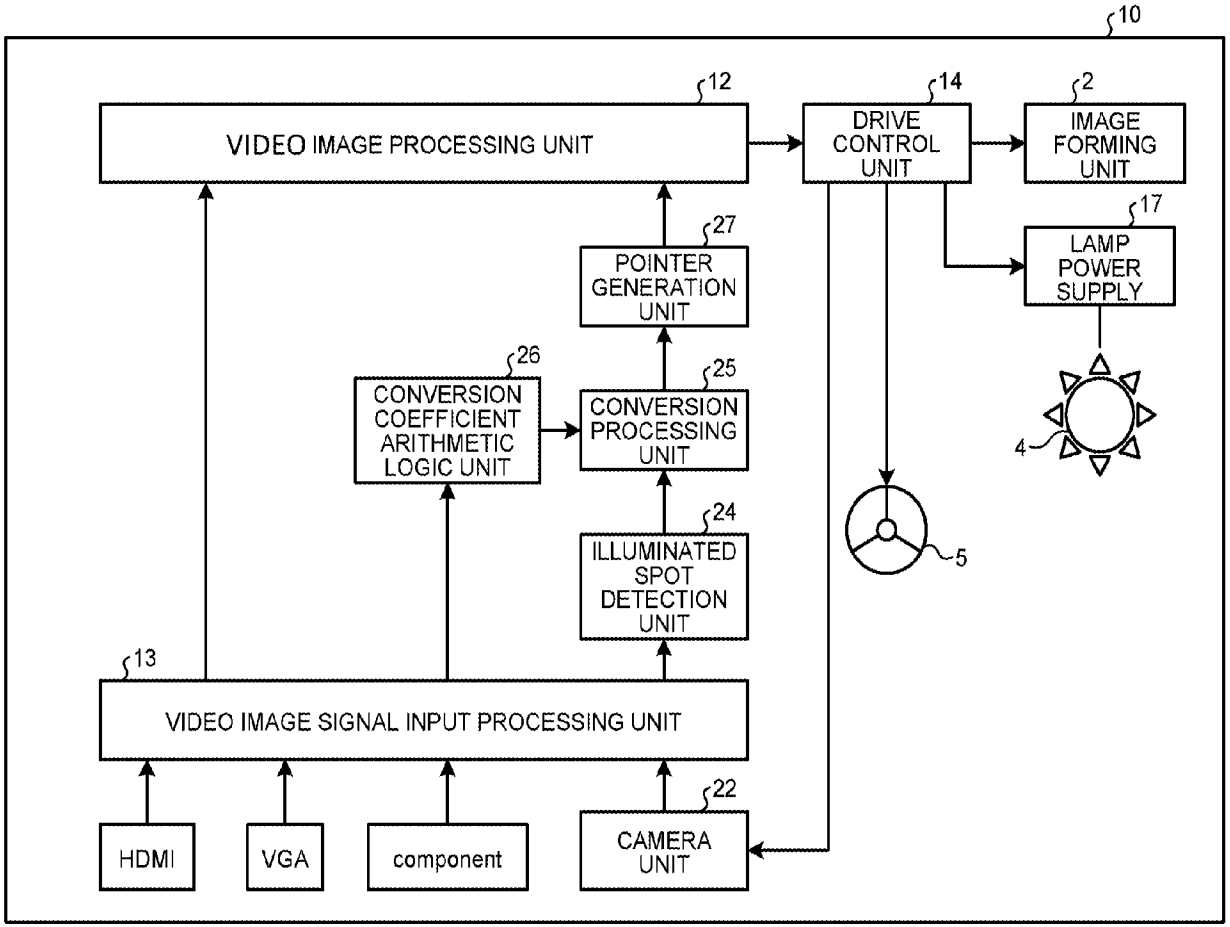
FIG. 3 is a block diagram of a functional configuration of the image projection device according to the embodiment.

FIG. 3 is a block diagram of a functional configuration of the image projection device 10. The image projection device 10 controls input of video image signals and perform control to synchronize driving of the projection system 3*b* and driving of the optical system 3*a*. As illustrated in FIG. 3, the image projection device 10 includes a video image processing unit 12, a video image signal input unit 13, a drive control unit 14, the camera unit 22 (image capturing unit), an light spot detection unit 24 (illumination image detection unit), a conversion processing unit 25, a conversion coefficient arithmetic logic unit 26, and a pointer generation unit 27.

First, digital signals according to, for example, HDMI (trademark), and analog signals, according to, for example, VGA or component signals, are input to the video image signal input unit 13 of the image projection device 10. The video image signal input unit 13 performs a process for processing a video image into RGB or YPbPr signals, etc. according to the input signals. If the input video image signal is a digital signal, the video image signal input unit 13 converts the digital signal into a bit format that is defined by the video image processing unit 12 according to the number of bits of the input signal. If the input signal is an analog signal input, the video image signal input unit 13 performs DAC processing for performing digital sampling on the analog signal, etc. and inputs the RGB or YPbPr format signals to the video image processing unit 12. Image data of a projected image that is captured by the camera unit 22 is also input to the video image signal input unit 13.

The video image processing unit 12 performs digital image processing, etc. according to the input signal. Specifically, proper image processing is performed according to the contrast, brightness, chroma, hue, RGB gain, sharpness, scaler function for scaling up/down, the characteristics of the drive control unit 14, and/or the like. The input signal on which the digital image processing has been performed is passed to the drive control unit 14. The video image processing unit 12 can also generate image signals of an arbitrarily specified or registered layout.

The drive control unit 14 determines conditions on driving the color wheel 5 that colors the white light according to the input signals, the image forming unit 2 that chooses whether to emit or discard light, and a lamp power supply 17 that controls the current for driving the lamp, and the drive control unit 14 issues a drive instruction to the color wheel 5, the image forming unit 2 and the lamp power supply 17. The drive control unit 14 controls the color wheel 5 to sequentially generate colors.

The processing performed by the drive control unit 14 includes a flow of processing for capturing an image of a projection pattern that is projected by the image projection device 10 and calculating a projection conversion coefficient from the difference between the position of coordinates in the projected data of the captured image and the position of coordinates in image data and a flow of processing for detecting an illuminated spot. First, a flow of processing for capturing an image of a projected projection pattern will be described.

The drive control unit 14 issues an image capturing instruction to the camera unit 22 in accordance with a synchronization signal in accordance with the timing of image projection. In other words, the drive control unit 14 is configured to serve also as an image capturing control unit according to the embodiment, but the drive control unit 14 and an image capturing control unit may be provided separately. When the image that is captured by the camera unit 22 is input to the video image signal input unit 13, the video image signal input unit 13 performs shading correction, Bayer conversion, color correction, and/or the like on the captured camera image to generate RGB signals. The video image processing unit 12 generates the projection pattern illustrated in FIG. 4 and the image projection device 10 projects the projection pattern.

The camera unit 22 captures an image of the scene resulting from projection of the projection pattern. The image capturing systems that may be employed by the camera unit 22 include a global shutter system and a rolling shutter system. The global shutter system exposes all pixels simultaneously and requires, for each pixel, a circuit more complicated than that for the rolling shutter system. However, there is an advantage that an image can be captured by exposing all the pixels at a time. In contrast, the rolling shutter system performs sequential scanning exposure, can be implemented with a simple circuit, and can capture an image by scanning. However, the image capturing timings are different between respective pixels and thus, when an image of an object moving fast is captured, distortion and/or the like may occur. It is preferable that the shutter speed of the camera unit 22 be controlled by the drive control unit 14. The drive control unit 14 determines and controls a shutter speed that is required for image capturing for the period of a timing that is specified by the synchronization signal.

On the basis of the captured image, the light spot detection unit 24 acquires coordinates of each lattice point on the projection surface on which the image is currently projected. The conversion coefficient arithmetic logic unit 26 calculates a projection conversion coefficient H that associates the coordinates (x,y) in the video image signal of the projection pattern with the coordinates (x',y') in the captured image and sets a parameter H in the conversion processing unit 25. The light spot detection unit 24 extracts the coordinates where the projection surface is illuminated. The conversion processing unit 25 performs projection conversion using the corresponding lattice point parameter H on the detected illuminated spot coordinates (x',y') so that the illuminated spot coordinates (x',y') are converted into the coordinates (x,y) of the illuminated spot coordinate in the video image signal. The pointer generation unit 27 (illumination image generation unit) generates illuminated spot image data at the coordinates (x,y). For the illuminated spot image data, for example, a circle having a diameter corresponding to z pixels about the coordinates (x,y) or a previously-registered pointer image may be generated with an arbitrary generating method. The pointer generation unit 27 performs calculations for the image generation, generates projection image signals, and transmits the projection image signal to a video image signal transmission unit 28. The video image processing unit 12 of the image projection device 10 superimposes the video image signal generated by the pointer generation unit 27 on the video image signal, performs arbitrary image processing, and then outputs a control signal to the drive control unit 14. Then, projection image data obtained by superimposing a pointer image is projected from the image projection device 10.

Figure 5:
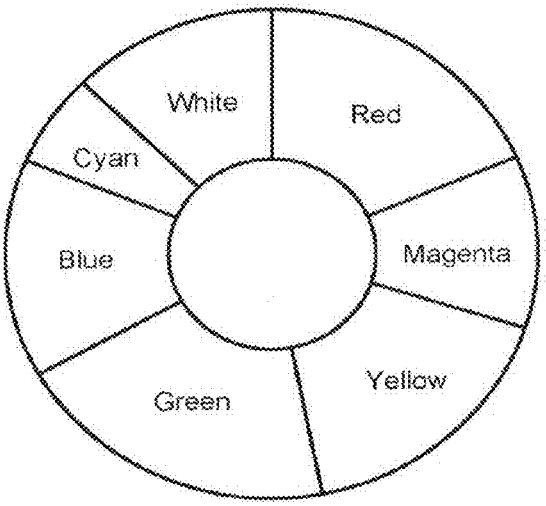
FIG. 5 illustrates seven segments of Cy, W, R, M, Y, G, and B of a color wheel according to the embodiment.
Figure 6:
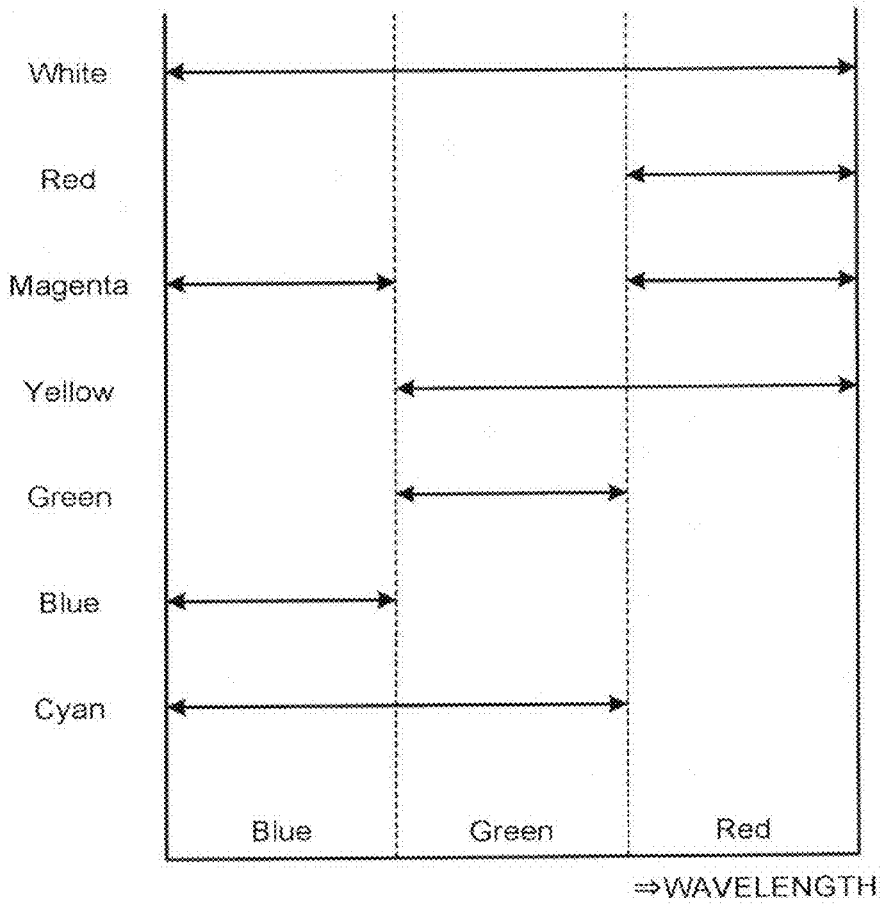
FIG. 6 illustrates a correlation between the seven segments of the color wheel and images captured by a camera when the display is performed based on respective segments on a projection surface according to the embodiment.

The flow of processing performed by the light spot detection unit 24 to detect the coordinates of a pointer that is caused to illuminate the projection surface will be described below. FIG. 5 illustrates seven segments (areas) of multiple colors of Cy, W, R, M, Y, G, and B of the color wheel. FIG. 6 illustrates a correlation between the seven segments of the color wheel and images captured by the camera when display is performed based on respective segments on the projection surface, i.e., RGB data. The drive control unit 14 performs control to cause, in time units, light to transmit through respective areas of the multiple colors of the color wheel 5, thereby realizing image data. For example, in the RED segment, RED data value from among R, G and B data is in the majority. The Red segment has a small transmittance to Green and Blue, which limits the light of these colors. Similarly, the Cyan segment corresponding to a secondary color transmits Blue and Green light and the White segment corresponding to a tertiary color transmits light of all R, G and B.

Figure 7:
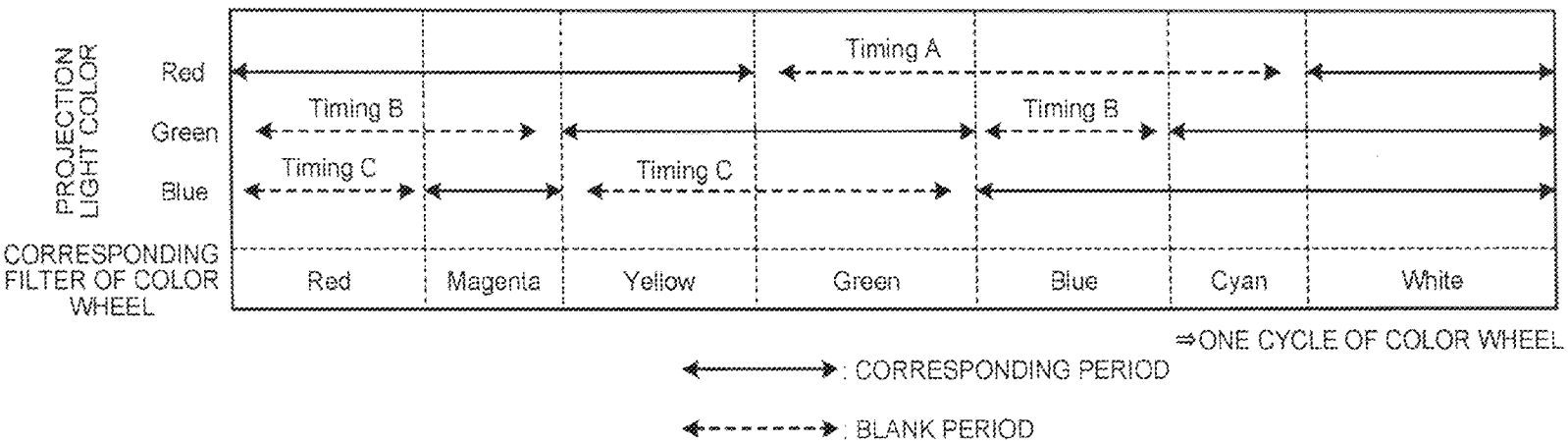
FIG. 7 illustrates the relationship between one cycle of a color wheel and light colors of projection.

FIG. 7 illustrates the relationship between one cycle of the color wheel and colors of projected light. The color of light is an idea including both of the color of light from the lamp, i.e., the light source, and the color that is visible from the light emitted from the device. The interval of a corresponding period indicated by a solid arrow in FIG. 7 represents an area where, in the luminous color, an image signal is projected via a corresponding segment of the color wheel 5. For example, regarding the projection light color of Red, the components classified into Red correspond to the interval of Red, Magenta, Yellow, and White. On the other hand, the interval indicated by the dotted arrow of Timing A is an interval where the video image signal is not projected. In other words, at the timing of the color wheel 5 corresponding to the timing of Timing A, the video image signal is not projected and therefore a laser pointer can be detected easily even if the laser pointer is red.

Figure 8:
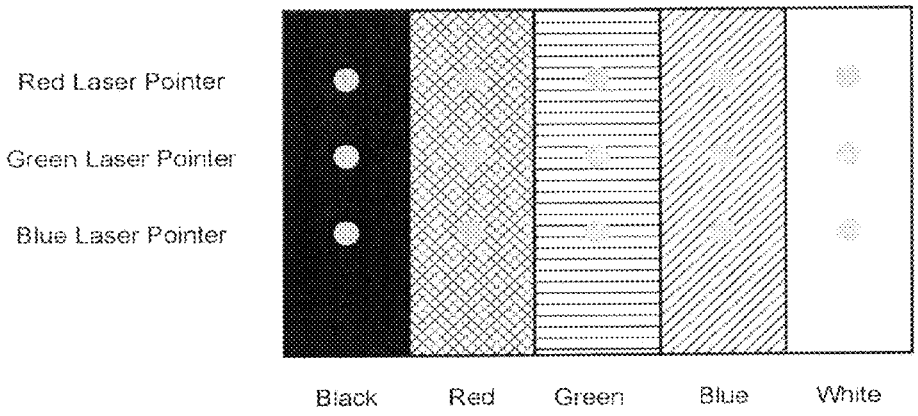
FIG. 8 illustrates image data when a projected image is illuminated with laser pointers of Red, Green or Blue.
Figure 9:
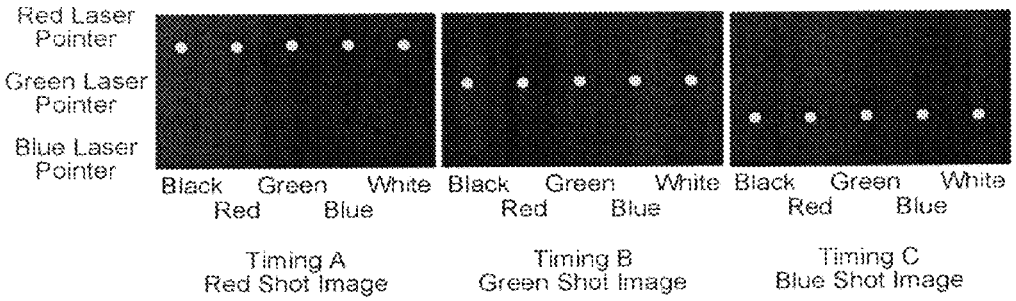
FIG. 9 illustrates laser pointers that are detected when images of the laser pointers that are caused to illuminate a projected image are captured at timings A, B and C.

Accordingly, in the embodiment, image capturing and detection of laser pointers of R, G and B that are caused to illuminate the projection pattern are performed in synchronization with such timing. FIG. 8 illustrates image data when the laser pointers of Red, Green and Blue are caused to illuminate a projection pattern. FIG. 9 illustrates laser pointers that are detected when images of the laser pointers that are caused to illuminate a projected image at timings A, B and C. The Timing A Red shot image shown in FIG. 9 represents the image data acquired by performing image capturing by the camera unit 22 in synchronization with the interval of Timing A. The synchronization with Timing A is implemented by setting a synchronization signal in accordance with the timing at which the drive control unit 14 of the image projection device 10 drives the color wheel 5. In other words, because the color wheel 5 rotates at a fixed frequency (120 Hz in the embodiment), a synchronization signal is set in accordance with the timing at which the color wheel 5 corresponds to Timing A.

In the interval of Timing A, no video image signal of a Red plane is emitted, which makes it easy to detect an illuminated spot of a laser pointer of red. For this reason, when illuminating light of a red pointer is detected, the accuracy of detection improves if image capturing is performed by the camera unit 22 in synchronization with Timing A. Similarly, regarding the Timing B Green shot image at Timing B, no video image signal of a Green plane is emitted, which improves accuracy of detection of a laser pointer of green. Furthermore, regarding the timing C Blue shot image at Timing C, no video image signal of a Blue plane is emitted, which makes it easy to detect an illuminated spot of a laser pointer of blue. As described above, the colors become easy to detect at respective timings and, by effectively utilizing each. Timing, multiple illuminated spots can be detected simultaneously.

A method of synchronizing image capturing by the camera unit 22 and driving of the color wheel 5 will be described here. The color wheel 5 is provided with a black seal serving as an index for detecting the rotation and the holder of the color wheel 5 is provided with a sensor for detecting the black seal. By acquiring the timing at which the black seal is detected from the sensor, the drive control unit 14 issues an instruction for generating a synchronization signal. The synchronization signal to be generated is determined so as to be in synchronization with the period in which a color closest to the color set for a spot illuminated by the laser pointer is not projected. Accordingly, the camera unit 22 that performs image capturing can control the shutter timing of image capturing in accordance with the synchronization signal of the color wheel.

Figure 10:
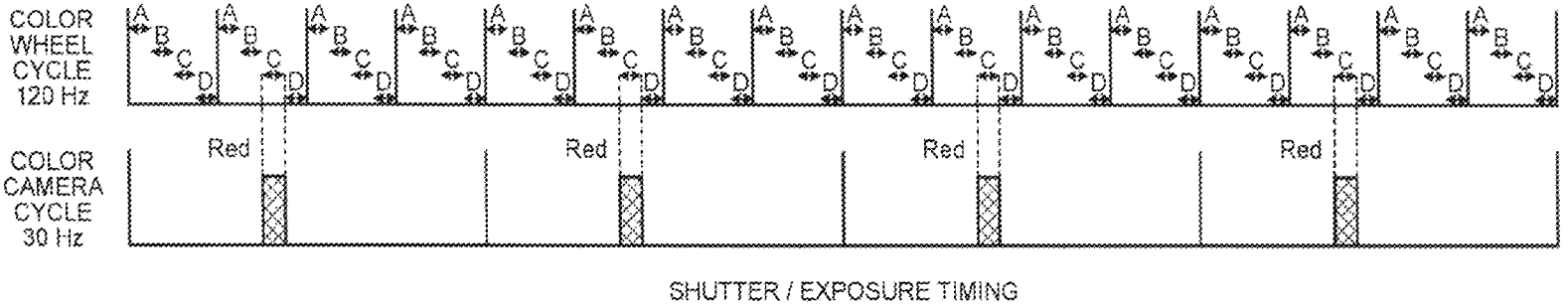
FIG. 10 illustrates the relationship, for detecting a laser pointer of a single color, between the cycle of rotation of the color wheel, the cycle of image capturing by an image capturing camera, and the shutter timing of the image capturing camera.
Figure 11:
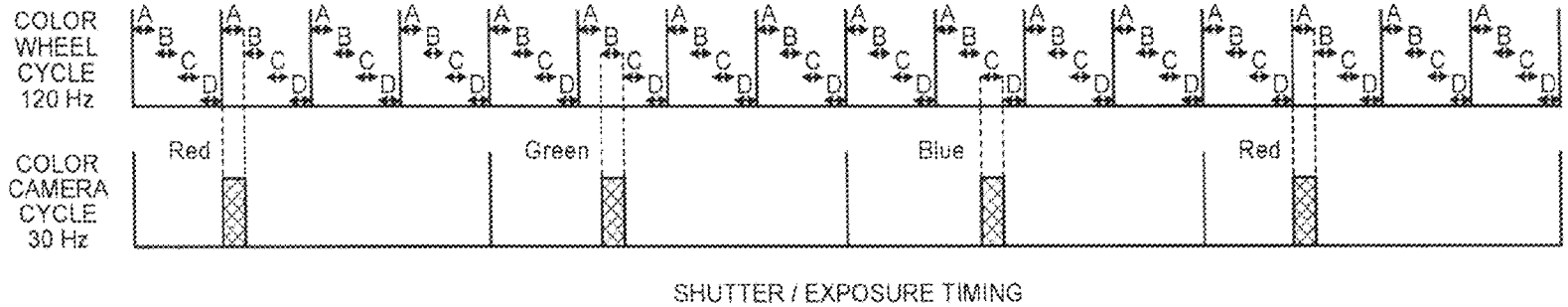
FIG. 11 illustrates the relationship, for detecting a laser pointer of multiple colors, between the cycle of rotation of the color wheel, the cycle of image capturing by an image capturing camera, and the shutter timing of the image capturing camera.

FIGS. 10 and 11 illustrates the relationship between the cycle of rotation of the color wheel, the cycle of image capturing by the image capturing camera, and the shutter timing of the image capturing camera. The color wheel 5 rotates at a cycle of 120 Hz and the color camera performs image capturing at a cycle of 30 Hz. In the embodiment, the color wheel 5 rotates four times while the camera unit 22 performs image capturing once. FIG. 10 illustrates exemplary timing for synchronizing image capturing in a case where the laser pointer has a red color. For example, the color of the laser pointer is set by the user by inputting a color via an interface for operating the image projection device 10 (setting unit). In the embodiment, the intervals C correspond to the Red blank intervals, i.e., correspond to Green, Blue, and Cyan of the color wheel 5 corresponding to Timing A. In such a case, the camera unit 22 performs exposure in one interval C at the first cycle to perform image capturing and, by observing the image thus captured, the spot illuminated by the laser pointer of red can be detected.

Normally, light is emitted to the screen 30 when the image forming unit 2 is on and no light is emitted when the image forming unit 2 is off. However, in the above-described example, by performing image capturing in synchronization with the corresponding timing even when the image forming unit 2 is on, an illuminated spot can be detected also from a color plane data of R, G or B. In other words, a spot illuminated by the laser pointer 40 can be detected regardless of the content of the video image.

FIG. 11 illustrates the synchronization method performed in a case where the laser pointer has multiple colors. The camera unit 22 performs exposure in one interval A in the first cycle to perform image capturing. The interval A corresponds to Timing A and, by observing the image data obtained by performing image capturing according to this timing, the spot illuminated by the laser pointer of Red can be detected. In the second cycle, exposure is performed in the interval B to perform image capturing. The interval B corresponds to Timing B and, by observing the image data obtained by performing image capturing according to this timing, the spot illuminated by the laser pointer of Green can be detected. Similarly, in the third cycle, an illuminated spot of Blue can be detected. Thereafter, similar control is performed. In the above-described case, the synchronization signal contains three types of timing: Timing A in the first cycle, Timing B in the second cycle, and Timing C in the third cycle. When multiple pointers of the same color are used, they are detected as multiple spots within the screen and thus the detection can be performed with no problem.

An example has been described where, when a laser pointer of multiple colors is detected, multiple colors are detected by using one camera. Alternatively, each camera for each color to be detected may be individually mounted and detection control may be performed for each color. In this case, there is no time when an image capturing task of the camera is occupied by other colors, and thus the detection interval of each single color can be short. In such a case, it is preferable to previously set which timing corresponds to which camera unit. In other words, for example, if three camera units are provided for three colors of R, G and B, each illuminated spot of the laser pointer of each color can be detected in each cycle.

Alternatively, when it is desired to detect a middle color, it is satisfactory if the areas of Timing A, Timing B, and Timing C are further divided for colors. In such a case, by performing image capturing at a timing corresponding to a middle color desired to be detected, detection can be performed for each segment of the color wheel 5.

Figure 12:
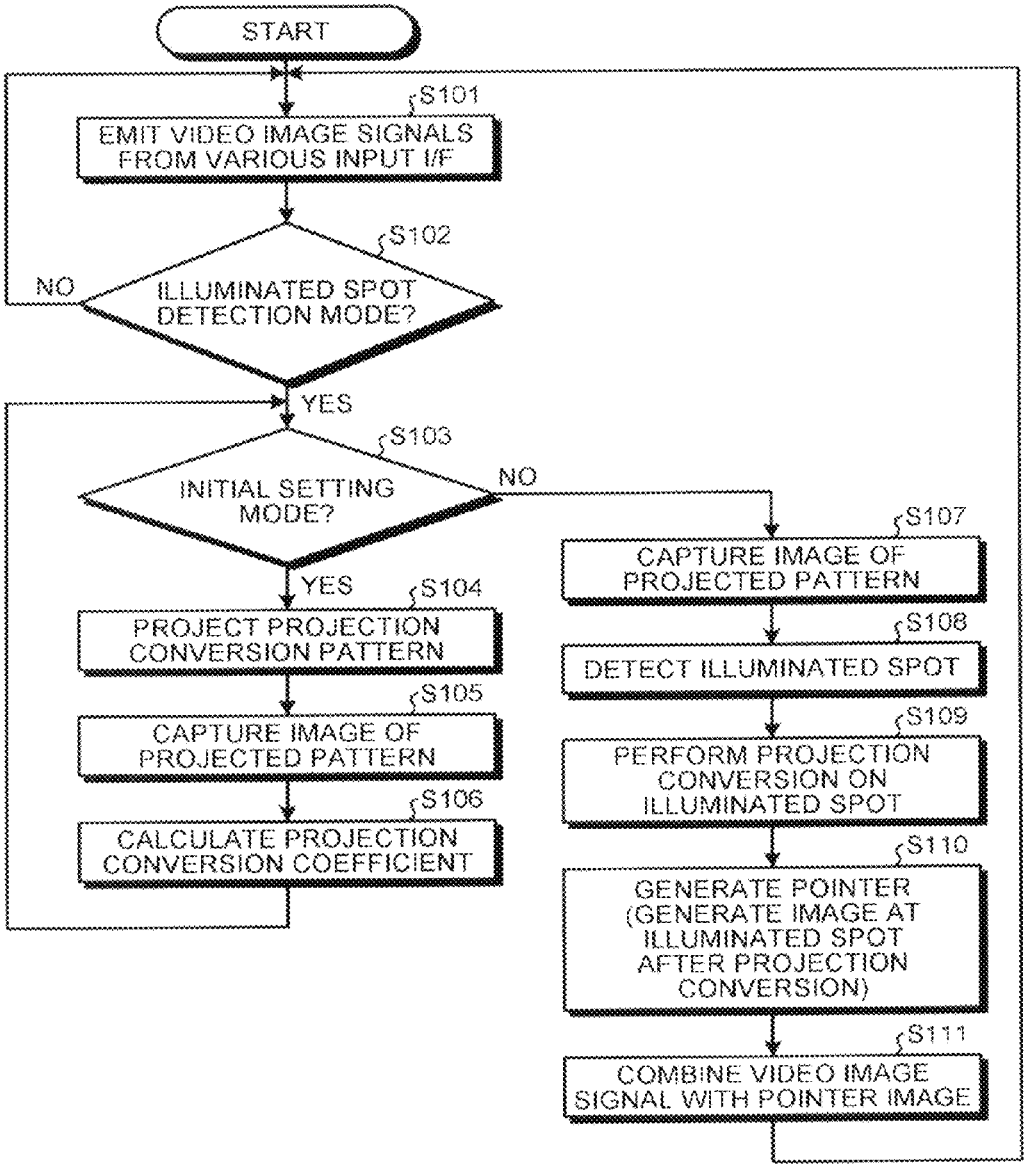
FIG. 12 is a flowchart of the flow of processing for calculating a projection conversion coefficient and for detecting a laser pointer.
Figure 13:
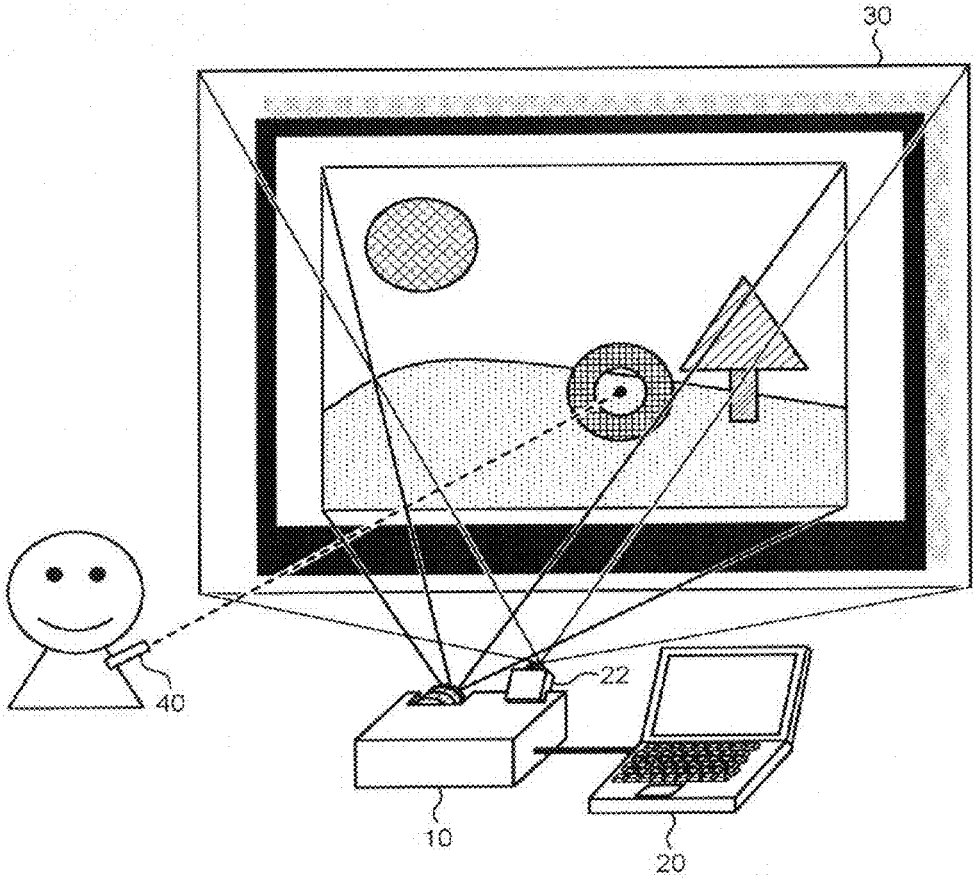
FIG. 13 illustrates a general view showing an exemplary mode of projection of a pointer according to the image projection device according to the embodiment.

The flow of processing for calculating a projection conversion coefficient and for detecting the laser pointer will be described with reference to FIG. 12. The processing illustrated in FIG. 12 is performed on the input video image signal on a frame-by-frame basis. As illustrated in FIG. 12, the drive control unit 14 performs processing for emitting video image signals that are input from a video image signal input I/F. (step S101). The drive control unit 14 then determines whether it is in an illuminated spot detection mode (step S102). In the illuminated spot detection mode, a spot that is illuminated by the illuminating device on the screen 30 is detected. The illuminated spot detection mode is started by, for example, an operation performed by the user on an operation screen or button when using the laser pointer. When it is determined that it is not in the illuminated spot detection mode (NO at step S102), the process returns to step S101 for the next frame of the image signal.

In contrast, when determining that it is in the illuminated spot detection mode, (YES at step S102), the drive control unit 14 determines whether it is in an initial setting mode (step S103). The initial setting mode is to calculate a projection conversion coefficient when the projection environment changes. If the illuminated spot detection mode is first started, it is in the initial setting mode. The determination may be made depending on, for example, whether a projection conversion coefficient has been set or whether a given time has elapsed after a projection conversion coefficient is set. The projection conversion coefficient is a coefficient for correcting the difference between the coordinates in an image signal before projection and the coordinates in a projected image pattern.

When determining that it is in the initial setting mode (YES at step S103), the drive control unit 14 drives the image forming unit 2 and so on to project a projection conversion image pattern (see FIG. 4) (step S104). The drive control unit 14 then captures an image of the image pattern projected by the drive control unit 14 according to the synchronization signal (step S105). The conversion coefficient arithmetic logic unit 26 then measures the difference between the coordinates in the image of the image pattern, which is captured by the camera unit 22 and input via the video image signal input unit 13, and the coordinates in the data of the projected image pattern and calculates a projection conversion coefficient such that the sets of coordinates in the two sets of data are matched with each other (step S106). The calculated projection conversion coefficient is saved and the process moves to step S103.

In contest, when determining that it is not in the initial setting mode (NO at step S103), the drive control unit 14 captures an image of the emitted pattern according to the image capturing timing that is specified by the synchronization signal (step S107). The image capturing timing is determined according to the color emitted by the laser pointer. Thus, the light spot detection unit 24 can detect the spot illuminated by the laser pointer from the image data of the captured image (step S108). The coordinates of the detected illuminated spot are input to the conversion processing unit 25 to perform projection conversion with the projection conversion coefficient, which is calculated by the conversion coefficient arithmetic logic unit 26, to convert the coordinates of the illuminated spot to the coordinates in the image data (step S109). The data of the coordinates obtained by the projection conversion is transmitted to the image projection device 10 and the video image processing unit 12 generates, for the original video image signal to be emitted, image data of the pointer to be combined at the received coordinates (step S110) and combines the video image signal with the image data of the pointer (step S111). In other words, projection image data is generated that is obtained by adding a given image according to the position of the detected illuminated spot.

Figure 14:
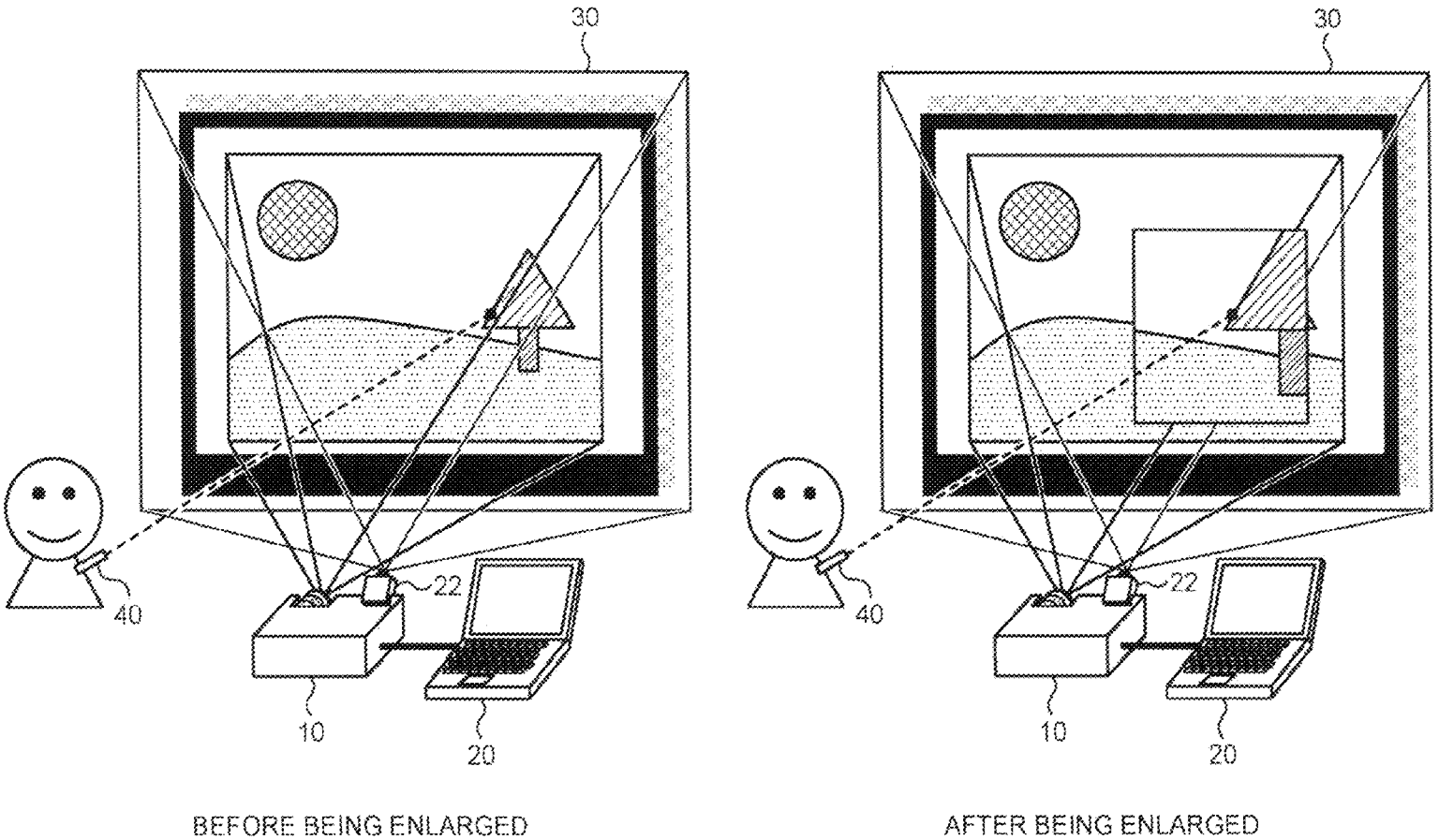
FIG. 14 illustrates a general view showing an exemplary mode of projection of the pointer according to the image projection device according to the embodiment.

Regarding the illuminated spot image data of the pointer to be combined, to increase the visibility, the laser pointer 40 that is enlarged from the original size around the calculated illuminated spot may be projected as illustrated in FIG. 7. In this case, the pointer is enlarged and thus can be viewed easily on the video image. Alternatively, as illustrated in FIG. 14, instead of enlarging the pointer, the video image processing unit 12 may perform projection such that a part of the image data area is enlarged around the calculated coordinates of the illuminated spot and displayed.

Figure 4:
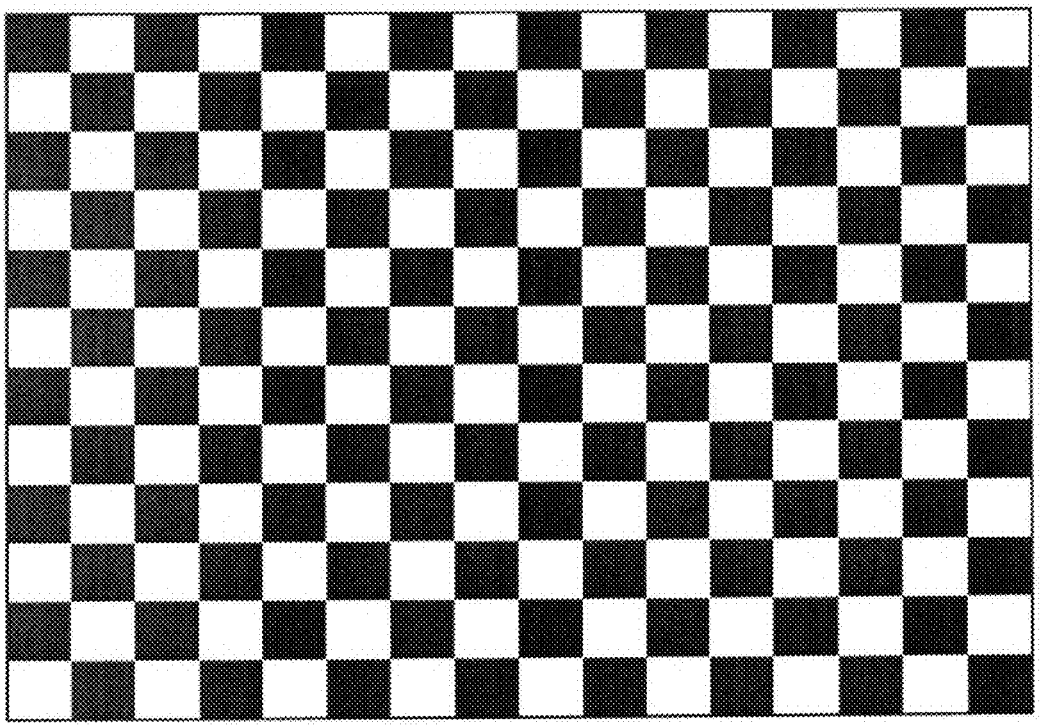
FIG. 4 illustrates an exemplary projection pattern according to the embodiment.
Figure 15:
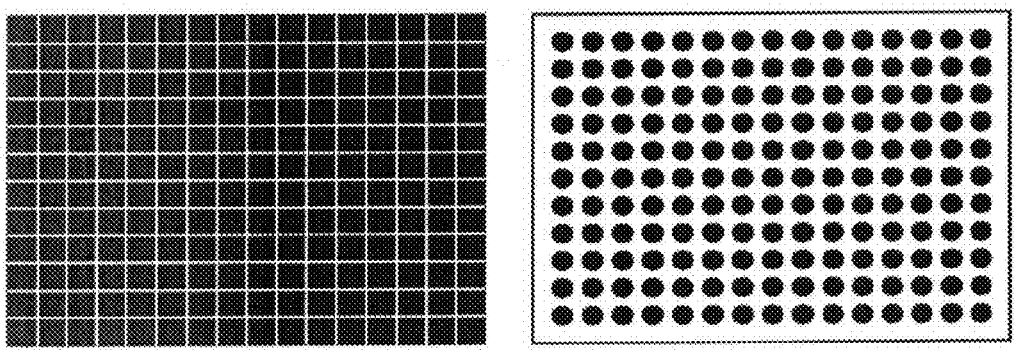
FIG. 15 illustrates an exemplary projection pattern according to the embodiment.

For the projection pattern to be projected to calculate a projection conversion coefficient, for example, in addition to the pattern illustrated in FIG. 4, a grid pattern or dot pattern like that illustrated in FIG. 15 may be used. With a dot projection pattern, even if a projection distortion causes a coordinate shift, accurate coordinates can be obtained by determining the center of gravity. With a grid pattern, a coordinate shift can be reduced and more accurate pattern extraction can be performed if it is expected that there is no disturbance from the ambient light.

The external PC 20 that is an information processing device is locally connected to the image projection device 10. Arithmetic operations and synchronization of image capturing may be performed by an information processing device that is connected via a network. For example, an arithmetic operation processing server with an advanced feature may be used to perform an initial projection conversion matrix operation, to download content to be superimposed, to perform image processing, and/or to perform the like.

Modification

Figure 16:
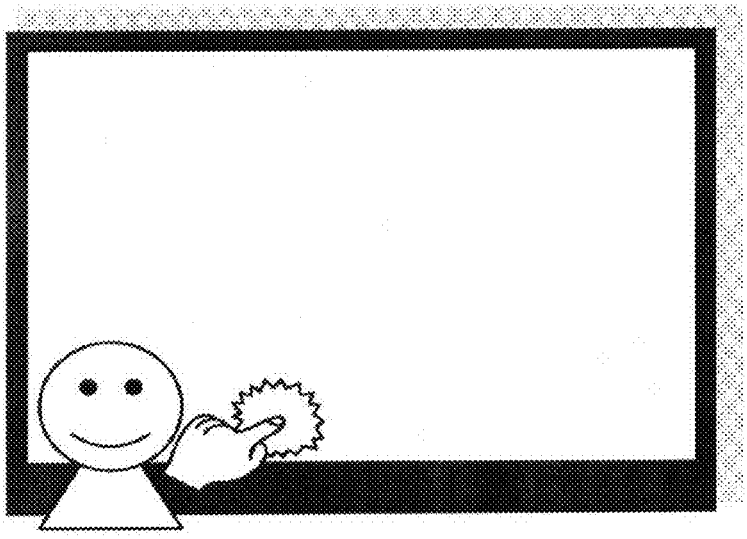
FIG. 16 illustrates an exemplary screen of a modification.

In the above-described embodiment, an image of an illuminated spot at which illuminating light from the illuminating device is incident on the projection surface is captured and image processing is performed according to the position of the spot. Alternatively, the light spot at which a light emitting substance emits light may be detected. FIG. 16 illustrates an exemplary screen of a modification.

For example, a substance (stress illuminant) that emits light when a pushing force (stress) is applied is known. By applying such a substance onto a screen, a screen that emits light in response to a stress (exemplary light spot device that produces a light spot) can be made. FIG. 16 illustrates that light is emitted at the spot on the screen that is pushed by the user.

In Modification, the light spot detection unit 24 detects, instead of the above-described illuminated spot, a light emitting spot (light spot) on the screen as illustrated in FIG. 16. Accordingly, the same processing as that of the embodiment can be implemented.

Figure 17:
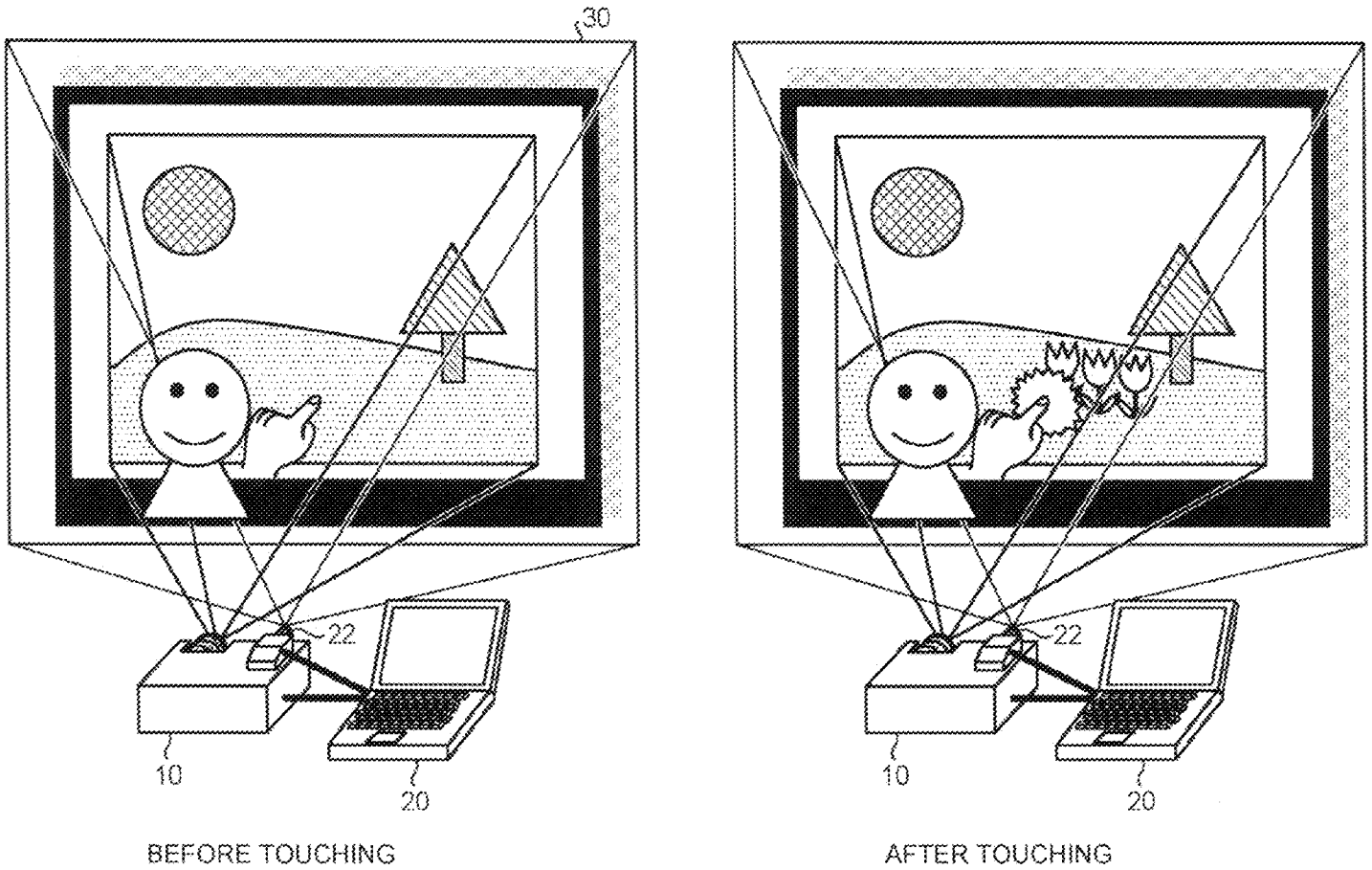
FIG. 17 illustrates a general view of an exemplary mode of projection of a pointer according to the image projection device according to the modification.

FIG. 17 illustrates an exemplary mode of pointer emission according to an image projection device of the modification. FIG. 17 illustrates an example where, by performing image processing on a projected image, a new image (an image of flowers shown in FIG. 17) is displayed at a light emitting spot.

Instead of using the light emitting screen, a tool with an LED (Light Emitting Diode) (an exemplary light spot device that produces a light spot), such as a ballpoint pen with a built-in LED, may be used. For example, the light spot detection unit 24 detects, instead of the above-described illuminated spot, light emission from a ballpoint pen with a built-in LED that emits light when pushing the screen. Accordingly, the same processing as that of the embodiment can be implemented.

The embodiment of the present invention has been described above. The above-described embodiment is represented as an example only and is not intended to limit the scope of the invention. The invention is not limited to the above-described embodiment and the components can be modified and embodied within the scope of the invention when the invention is carried out. By properly combining the components disclosed in the above-described embodiment, various inventions can be formed. For example, some components can be omitted from the whole components shown in the embodiment.

A program that is executed by the image projection device according to the embodiment is previously incorporated in, for example, a ROM and provided. The program that is executed by the image projection device according to the embodiment may be recorded in a computer-readable recording medium, such as a CD-ROM, flexible disk (FD), CD-R, DVD (Digital Versatile Disk), in an installable or executable file and be provided.

Alternatively, the program that is executed by the image projection device according to the embodiment may be stored in a computer that is connected to a network, such as the Internet, and downloaded via the network so as to be provided. Alternatively, the program that is executed by the image projection device according to the embodiment may be provided or distributed via a network, such as the Internet.

The program that is executed by the image projection device according to the embodiment has a module configuration including the above-described units. For practical hardware, a CPU (processor) reads the program from the ROM and executes the program so that the above-described units are loaded and generated in the main storage device. Alternatively, the units of an image projection device may be implemented as hardware according to a given combination of electronic circuits.

The image projection device according to an embodiment can detect a pointer accurately without affected by video image signals.

An image projection device includes: a drive control unit that, when image data is projected onto a projection surface, causes light colors of the image data to be produced by performing control to cause, in time units, light to be transmitted to respective areas of multiple colors that are determined by light colors of the image data; a setting unit that sets a light color of an illuminating device that illuminates an illuminated spot on the projection surface; an image capturing control unit that, for, receives a synchronization signal that specifies a timing at which light of the set light color of the illuminated point illuminated by the illuminating device related to the areas of the multiple colors is not projected, and controls exposure and image capturing of an image capturing unit in accordance with the timing that is specified by the synchronization signal to capture an image of the projected image data; an illuminated spot detection unit that detects, from the image of the captured image data, the spot on the projection surface illuminated by the illuminating device; a conversion processing unit that converts coordinates of the detected illuminated spot into coordinates of the illuminated spot in the image data by using a projection conversion coefficient that is calculated from a difference between the projected image data on the projection surface and the image data before being projected; and an illuminated spot generation unit that generates illuminated spot image data that is obtained by combining the illuminated spot at the converted coordinates of the illuminated spot.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image projection device comprising:

a color wheel:

a sensor that detects a timing of rotation of the color wheel and outputs a detection signal;

a drive control unit to control a sequential generation of light colors, the generation of light colors creating an illumination image using a light source and the rotation of the color wheel, the drive control unit outputting a synchronization signal based on the detection signal output by the sensor;

a setting unit that sets a color of an illumination image;

an image capturing control unit that receives, from the drive control unit, the synchronization signal that specifies a timing at which light of a color closest to the set color of the illumination image is not projected and causes an image of a projection surface to be captured in accordance with the timing that is specified by the synchronization signal;

an illumination image detection unit that detects, from captured image data, the illumination image that is produced by illuminating the projection surface by an illuminating device which includes the light source and the color wheel; and an illumination image generation unit that generates projection image data obtained by combining given image data at a position at which the illumination image is detected.

2. The image projection device according to claim 1, wherein, when the illumination image produced by the illuminating device contains light of multiple color tones, the synchronization signal specifies, as timings at which an image of the projection surface is captured, multiple periods in each of which light of a color closest to each of set multiple colors contained in the illumination image is not projected; and the image capturing control unit causes an image of the projection surface to be captured in accordance with each of the timings that are specified by the synchronization signal.

3. The image projection device according to claim 2, further comprising a plurality of image capturing units, wherein the image capturing control unit associates the image capturing units with the respective timings that are specified for the respective multiple colors of the illumination image and causes the image capturing units to individually capture images in accordance with the respective timings.

4. The image projection device according to claim 1, wherein the illumination image generation unit generates, at coordinates of the illumination image that is detected by the illumination image detection unit, an enlarged image of a given area of the image data, which is an area determined according to the coordinates of the illumination image, as the projection image data.

5. The image projection device according to claim 1, wherein the illumination image generation unit generates, at coordinates of the illumination image that is detected by the illumination image detection unit and around the coordinates, the illumination image greater than calculated coordinate points as the projection image data.

6. The image projection device according to claim 1, wherein:

the image capture control unit captures an image of the projection surface at the timing that is specified by the synchronization signal and that is changed each time the color wheel makes one rotation.

7. An image projection device comprising:

a color wheel;

a sensor that detects a timing of rotation of the color wheel and outputs a detection signal;

a drive control unit to control a sequential generation of light colors, the generation of light colors creating an illumination image using a light source and the rotation of the color wheel the drive control unit outputting a synchronization signal based on the detection signal output by the sensor;

a drive control unit that generates colors sequentially;

a setting unit that sets a color of the illumination image;

an image capturing control unit that receives, from the drive control unit, the synchronization signal that specifies a timing at which light of a color closest to the set color of the illumination image is not projected and causes an image of a projection surface to be captured in accordance with the timing that is specified by the synchronization signal;

a light spot device that produces a light spot around the projection surface from the captured image data;

a light spot detection unit that detects the light spot that is produced around the light spot device; and a light spot image generation unit that generates projection image data obtained by combining given image data at a position at which the light spot is detected.

8. The image projection device according to claim 7, wherein, when an image of the light spot contains light of multiple color tones, the synchronization signal specifies, as timings at which an image of the projection surface is captured, multiple periods in each of which light of a color closest to each of set multiple colors contained in the light spot image is not projected; and the image capturing control unit causes an image of the projection surface to be captured in accordance with each of the timings that are specified by the synchronization signal.

9. The image projection device according to claim 8, further comprising a plurality of image capturing units, wherein the image capturing control unit associates the image capturing units with the respective timings that are specified for the respective multiple colors of the light spot image and causes the image capturing units to individually capture images in accordance with the respective timings.

10. The image projection device according to claim 7, wherein the light spot image generation unit generates, at coordinates of the light spot that is detected by the light spot detection unit, an enlarged image of a given area of the image data, which is an area determined according to the coordinates of the light spot, as the projection image data.

11. The image projection device according to claim 7, wherein the light spot image generation unit generates, at coordinates of the light spot that is detected by the light spot detection unit and around the coordinates, the light spot image greater than calculated coordinate points as the projection image data.

* * * * *